US011173495B2

(12) United States Patent
Kurata et al.

(10) Patent No.: US 11,173,495 B2
(45) Date of Patent: Nov. 16, 2021

(54) CRUSHING APPARATUS

(71) Applicant: SEIKO EPSON CORPORATION, Tokyo (JP)

(72) Inventors: Hiroki Kurata, Nagano (JP); Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

(21) Appl. No.: 16/748,838

(22) Filed: Jan. 22, 2020

(65) Prior Publication Data

US 2020/0238293 A1 Jul. 30, 2020

(30) Foreign Application Priority Data

Jan. 24, 2019 (JP) ..... JP2019-010193

(51) Int. Cl.

| | |
|---|---|
| ***B02C 18/10*** | (2006.01) |
| ***B02C 18/18*** | (2006.01) |
| ***B02C 18/14*** | (2006.01) |
| ***B02C 18/00*** | (2006.01) |
| ***D21B 1/10*** | (2006.01) |

(52) U.S. Cl.

CPC ..... *B02C 18/10* (2013.01); *B02C 18/18* (2013.01)

(58) Field of Classification Search

CPC ..... B02C 18/10; B02C 18/18; B02C 18/142; B02C 18/182; B02C 18/0007; D21B 1/10

USPC ..... 241/236

See application file for complete search history.

(56) References Cited

U.S. PATENT DOCUMENTS 2,219,077 A * 10/1940 Pharo ..... D02G 3/20 241/102
2,459,240 A * 1/1949 Pharo ..... D02G 3/20 241/159
4,260,115 A * 4/1981 Hatanaka ..... B02C 18/182 241/236
4,627,582 A * 12/1986 Goldhammer ..... B02C 18/182 241/236
4,690,340 A * 9/1987 Hatanaka ..... B02C 18/0007 241/236
4,776,525 A 10/1988 Hatanaka
4,844,366 A 7/1989 Hatanaka (Continued)

FOREIGN PATENT DOCUMENTS

JP 69-016552 A 1/1984
JP 2012-144819 A 8/2012
JP 2018-161241 A 10/2018

*Primary Examiner* — Faye Francis
*Assistant Examiner* — Mohammed S. Alawadi
(74) *Attorney, Agent, or Firm* — Global IP Counselors, LLP

(57) ABSTRACT

A crushing apparatus includes a first rotary shaft member, a second rotary shaft member, a plurality of first rotary cutters, a plurality of second rotary cutters, a plurality of first spacers, and a plurality of second spacers, the first rotary cutters and the first spacers being alternately disposed in a first axis direction, the second rotary cutters and the second spacers being alternately disposed in the first axis direction, the first rotary cutters and the second rotary cutters each forming a tearing blade that protrudes in a direction perpendicular to the first axis direction, a portion of each of the first rotary cutters and a portion of each of the second rotary cutters overlapping when viewed from the first axis direction, and a gap being provided between the first rotary cutter and the second rotary cutter in the first axis direction.

3 Claims, 10 Drawing Sheets

(56) References Cited

U.S. PATENT DOCUMENTS 5,295,633 A * 3/1994 Kimbro ..... B02C 18/0007 241/166
5,427,321 A * 6/1995 Takahashi ..... D21B 1/10 241/73
5,676,321 A * 10/1997 Kroger ..... B02C 18/182 241/236
5,954,280 A * 9/1999 Kroger ..... B02C 18/0007 241/166
6,089,482 A * 7/2000 Chang ..... B02C 18/0007 241/236
6,260,780 B1 * 7/2001 Kroger ..... B02C 18/0007 241/236
6,983,903 B2 * 1/2006 Chang ..... B02C 18/0007 241/236
7,677,483 B2 * 3/2010 Romanovich ..... B02C 18/0007 241/100
8,418,947 B2 * 4/2013 Chan ..... B02C 18/0007 241/295
8,646,714 B2 * 2/2014 Chen ..... B02C 18/0007 241/236
8,882,965 B2 11/2014 Yamagami et al.
9,194,081 B2 11/2015 Yamagami
9,435,078 B2 9/2016 Yamagami et al.
2003/0218087 A1 * 11/2003 Ho ..... B02C 18/0007 241/236
2006/0219826 A1 * 10/2006 Yamamoto ..... B02C 18/0007 241/30
2007/0152089 A1 * 7/2007 Chen ..... B02C 18/182 241/236
2012/0037738 A1 * 2/2012 Pan ..... B02C 18/142 241/220
2012/0217331 A1 * 8/2012 Chan ..... B02C 18/0007 241/220
2013/0099040 A1 * 4/2013 Chen ..... B02C 18/182 241/292.1
2015/0041576 A1 * 2/2015 Romanovich ..... B02C 18/146 241/236
2015/0273477 A1 * 10/2015 Chen ..... B23P 15/406 241/292.1
2019/0264391 A1 * 8/2019 Abe ..... D21F 7/006
2020/0122157 A1 * 4/2020 Ho ..... B02C 18/2216

* cited by examiner

CRUSHING APPARATUS

The present application is based on, and claims priority from JP Application Serial Number 2019-010193, filed Jan. 24, 2019, the disclosure of which is hereby incorporated by reference herein in its entirety.

BACKGROUND

1. Technical Field

The present disclosure relates to a crushing apparatus.

2. Related Art

A crushing apparatus for crushing paper is known. For example, in JP-A-59-16552, as a crushing apparatus, there is described a document shredding machine having two rotary shafts parallel to each other, in which a large number of rotary cutters and spacers that rotate together with the respective shafts are alternately inserted into the respective shafts, and the rotary cutters of both shafts are arranged to mesh with each other.

For example, JP-A-2012-144819 describes that in a paper recycling apparatus, waste paper is divided into pieces of paper that are several centimeters square with a crushing blade of a crusher.

In the paper recycling apparatus as described above, it is desired to produce recycled paper with high paper strength. However, since the rotary cutter of the crushing apparatus described in JP-A-59-16552 has good sharpness, when the rotary cutter is used to cut paper into paper pieces, the fiber length tends to be short, and it is difficult to produce recycled paper with high paper strength.

SUMMARY

According to an aspect of the present disclosure, a crushing apparatus includes a first rotary shaft member that rotates about a first axis, a second rotary shaft member that rotates about a second axis parallel to the first axis in an opposite direction to a direction in which the first rotary shaft member rotates, a plurality of first rotary cutters provided on the first rotary shaft member and rotating together with the first rotary shaft member, a plurality of second rotary cutters provided on the second rotary shaft member and rotating together with the second rotary shaft member, a plurality of first spacers provided on the first rotary shaft member, and a plurality of second spacers provided on the second rotary shaft member, in which the first rotary cutters and the first spacers are alternately disposed in a first axis direction, the second rotary cutters and the second spacers are alternately disposed in the first axis direction, the first rotary cutters and the second rotary cutters each form a tearing blade that protrudes in a direction perpendicular to the first axis direction, a portion of each of the first rotary cutters and a portion of each of the second rotary cutters overlap when viewed from the first axis direction, and a gap is provided between the first rotary cutter and the second rotary cutter in the first axis direction.

In the crushing apparatus according to an aspect, the first rotary cutter and the second rotary cutter may each include a first surface and a second surface that are perpendicular to the first axis direction, a third surface formed in a thickness direction of the first rotary cutter and the second rotary cutter, the tearing blade being provided on the third surface, and a ripping blade protruding in a direction intersecting the second surface between the second surface and the third surface, and a size of the gap may be larger than a size of the ripping blade in the first axis direction.

In the crushing apparatus according to an aspect, the third surface may include a protruding portion protruding in the direction perpendicular to the first axis direction, and a corner portion of the protruding portion provided on the third surface may have an obtuse angle of 90° or more, or the corner portion may be chamfered.

The crushing apparatus according to an aspect may further include a first gap-forming member provided on the first rotary shaft member and forming the gap, and a second gap-forming member provided on the second rotary shaft member and forming the gap.

DESCRIPTION OF EXEMPLARY EMBODIMENTS

Below, a preferred embodiment of the disclosure will be described with reference to the drawings. Further, the embodiments described below do not unduly limit the contents of the present disclosure described in the claims. In addition, not all of the configurations described below are essential constituent requirements of the present disclosure.

1. First Embodiment

1.1. Crushing Apparatus

1.1.1. Configuration

Figure 1:
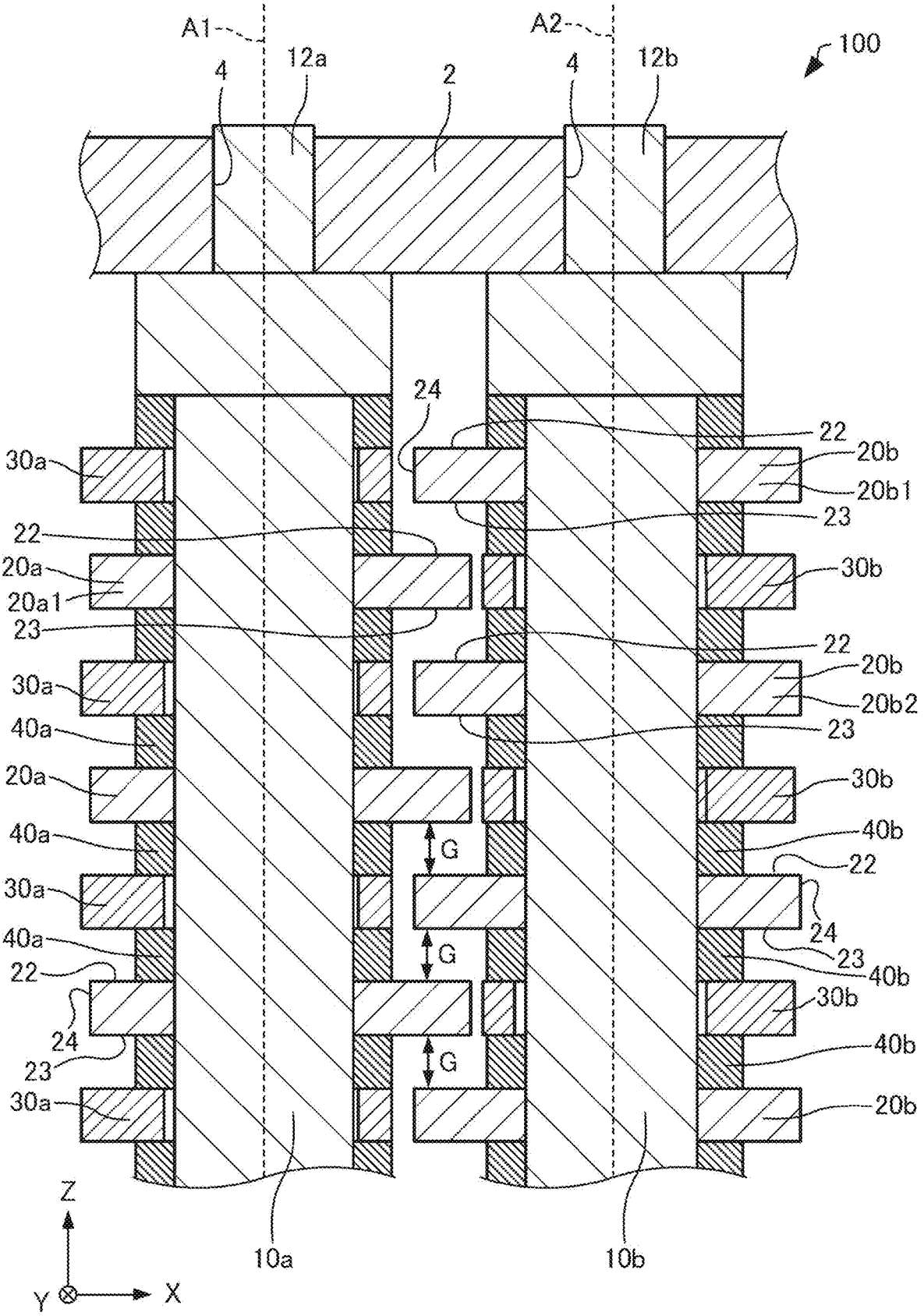
FIG. 1 is a sectional view schematically illustrating a crushing apparatus according to a first embodiment.
Figure 2:
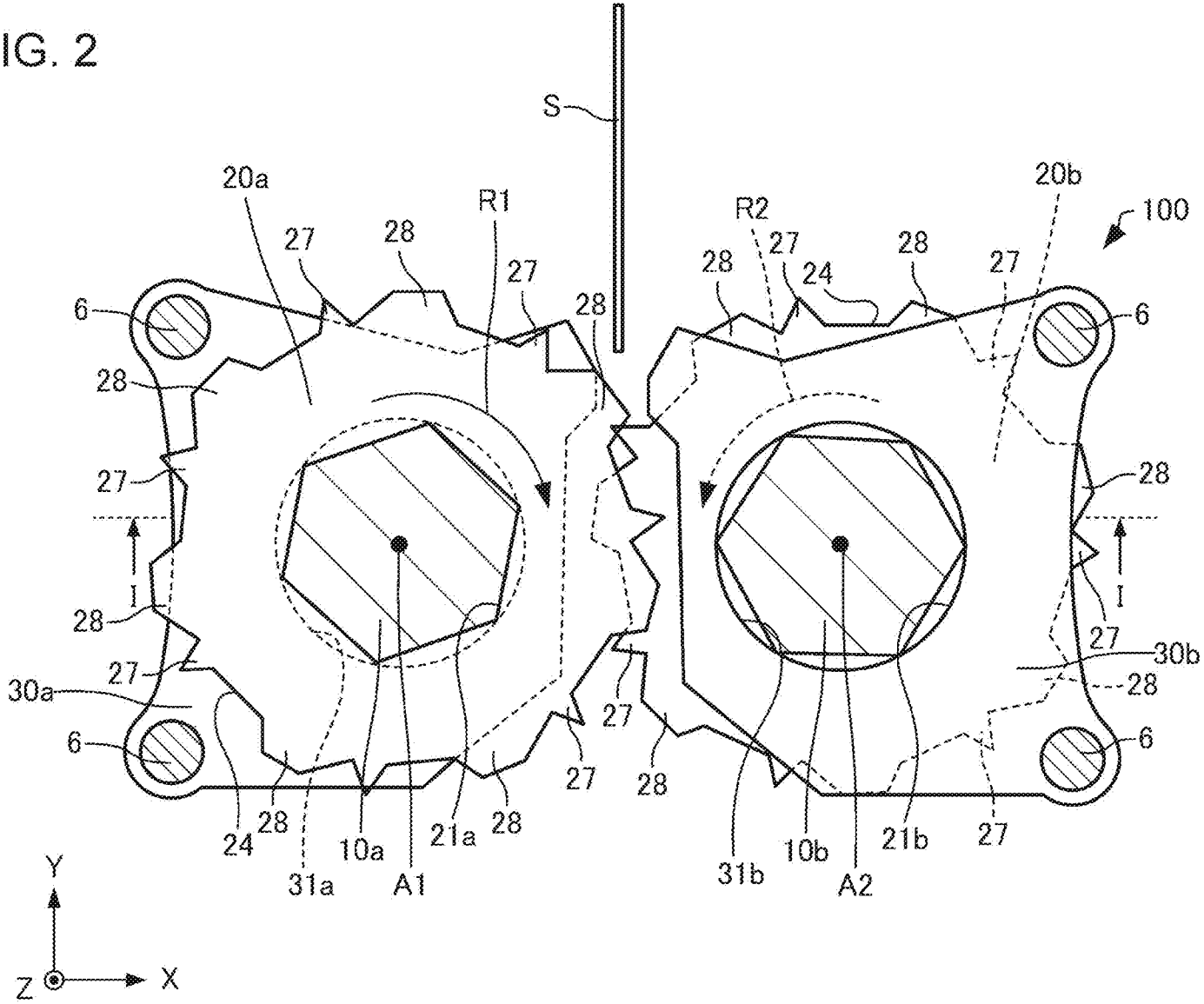
FIG. 2 is a plan view schematically illustrating the crushing apparatus according to the first embodiment.

First, the crushing apparatus according to the first embodiment will be described with reference to the drawings. FIG. 1 is a sectional view schematically illustrating a crushing apparatus 100 according to the first embodiment. FIG. 2 is a plan view schematically illustrating the crushing apparatus 100 according to the first embodiment. Further, FIG. 1 is a sectional view taken along line I-I of FIG. 2. In addition, in FIGS. 1 and 2, the X axis, the Y axis, and the Z axis are illustrated as three axes perpendicular to each other.

As illustrated in FIGS. 1 and 2, the crushing apparatus 100 includes, for example, a first rotary shaft member 10*a*, a second rotary shaft member 10*b*, a first rotary cutter 20*a*, a second rotary cutter 20*b*, a first spacer 30*a*, a second spacer 30*b*, a first gap-forming member 40*a*, and a second gap-forming member 40*b*. Further, for convenience, illustration of members other than the rotary shaft members 10*a* and 10*b*, the rotary cutters 20*a* and 20*b*, and the spacers 30*a* and 30*b* is omitted in FIG. 2.

The first rotary shaft member 10*a* rotates about a first axis A1. The second rotary shaft member 10*b* rotates about a second axis A2 parallel to the first axis A1 in the opposite direction to the direction in which the first rotary shaft member 10*a* rotates. In the illustrated example, the first axis A1 and the second axis A2 are axes parallel to the Z axis. The first rotary shaft member 10*a* is located in the −X axis direction away from the second rotary shaft member 10*b*.

The rotary shaft members 10*a* and 10*b* are supported by a fixed frame 2. In the illustrated example, a distal end portion 12*a* of the first rotary shaft member 10*a* and a distal end portion 12*b* of the second rotary shaft member 10*b* are supported by a bearing portion 4 of the fixed frame 2 so as to rotate. The distal end portions 12*a* and 12*b* are +Z-axis direction end portions of the rotary shaft members 10*a* and 10*b*, respectively.

Further, the fixed frame 2 houses the rotary shaft members 10*a* and 10*b*, the rotary cutters 20*a* and 20*b*, the spacers 30*a* and 30*b*, and the gap-forming members 40*a* and 40*b*. Although not illustrated, the fixed frame 2 is provided with a slot for loading the sheet S to be roughly crushed.

The shape of the rotary shaft members 10*a* and 10*b* is, for example, a hexagon when viewed from the direction of the first axis A1. Further, the shape of the rotary shaft members 10*a* and 10*b* seen from the first axis A1 direction is not specifically limited, and a circle, a polygon other than a hexagon, or the like may suffice. The first axis A1 direction is a direction in which the first axis A1 extends, and is the Z-axis direction in the illustrated example.

The first rotary cutter 20*a* is provided on the first rotary shaft member 10*a*. The first rotary cutter 20*a* is provided in a plurality. The first rotary cutters 20*a* are fixed to the first rotary shaft member 10*a* and rotate in a direction R1 illustrated in FIG. 2 together with the first rotary shaft member 10*a*. The first rotary cutters 20*a* are each provided with, for example, a through hole 21*a* penetrating in the Z-axis direction, and the through hole 21*a* and the first rotary shaft member 10*a* are fitted to each other.

The second rotary cutter 20*b* is provided on the second rotary shaft member 10*b*. The second rotary cutter 20*b* is provided in a plurality. The second rotary cutters 20*b* are fixed to the second rotary shaft member 10*b* and rotate in a direction R2 illustrated in FIG. 2 together with the second rotary shaft member 10*b*. The second rotary cutters 20*b* are each provided with, for example, a through hole 21*b* penetrating in the Z-axis direction, and the through hole 21*b* and the second rotary shaft member 10*b* are fitted to each other. The material of the rotary cutters 20*a* and 20*b* is, for example, a metal.

The rotary cutters 20*a* and 20*b* are, for example, planar plate members having a thickness in the Z-axis direction. The thickness of the rotary cutters 20*a* and 20*b* is, for example, 1 mm or more and 5 mm or less, and is preferably 2 mm. The shape of the first rotary cutters 20*a* and the shape of the second rotary cutters 20*b* are, for example, the same.

Figure 3:
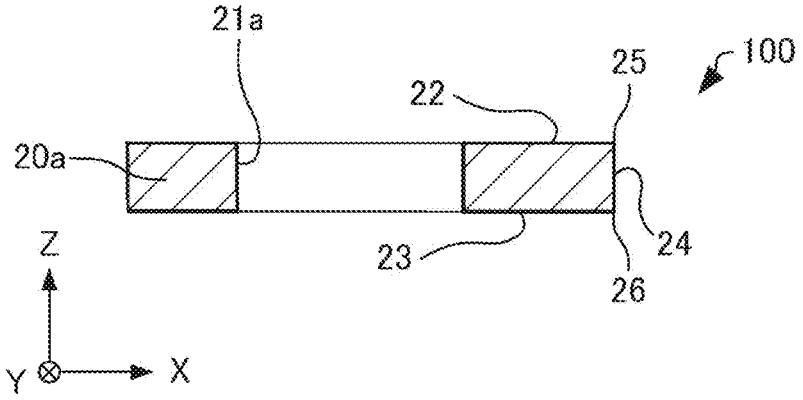
FIG. 3 is a sectional view schematically illustrating a first rotary cutter of the crushing apparatus according to the first embodiment.

Here, FIG. 3 is a sectional view schematically illustrating the first rotary cutters 20*a*. The rotary cutters 20*a* and 20*b* each have a first surface 22, a second surface 23, and a third surface 24, as illustrated in FIG. 3. The first surface 22 and the second surface 23 are surfaces perpendicular to the first axis A1 direction. In the illustrated example, the surfaces 22 and 23 are surfaces parallel to the XY plane, and the first surface 22 is located in the +Z-axis direction away from the second surface 23. The third surface 24 is a surface that couples the first surface 22 and the second surface 23, and is a surface that forms the outer periphery of the rotary cutters 20*a* and 20*b*. The third surface 24 is a surface formed in the thickness direction of the rotary cutters 20*a* and 20*b*.

The rotary cutters 20*a* and 20*b* each have a corner portion 25 between the first surface 22 and the third surface 24, and a corner portion 26 between the second surface 23 and the third surface 24. The corner portion 25 is a coupling portion between the first surface 22 and the third surface 24, and is a corner portion constituted by the first surface 22 and the third surface 24. The corner portion 26 is a coupling portion between the second surface 23 and the third surface 24, and is a corner portion constituted by the second surface 23 and the third surface 24.

The rotary cutters 20*a* and 20*b* each have a tearing blade 27 as illustrated in FIG. 2. The rotary cutters 20*a* and 20*b* form the tearing blade 27. The third surface 24 forms the tearing blade 27, which protrudes in a direction perpendicular to the first axis A1 direction. The tearing blade 27 is provided on the third surface 24. The tearing blade 27 protrudes in a direction perpendicular to the first axis A1 direction from a portion of the third surface 24 that does not form the tearing blade 27 and a protruding portion 28. The shape of the tearing blade 27 is, for example, a substantially triangular shape when viewed from the Z-axis direction. The tearing blades 27 is a blade that forms, in the sheet S, slits that extend in a direction perpendicular to a loading direction of the sheet S.

The tearing blade 27 is, for example, provided in a plurality. The plurality of tearing blades 27 of the first rotary cutter 20*a* are provided at predetermined intervals along the rotation direction R1 of the first rotary cutter 20*a*. The plurality of tearing blades 27 of the second rotary cutter 20*b* are provided at predetermined intervals along the rotation direction R2 of the second rotary cutter 20*b*.

The rotary cutters 20*a* and 20*b* have the protruding portion 28. The third surface 24 forms the protruding portion 28, which protrudes in a direction perpendicular to the first axis A1 direction. The third surface 24 includes the protruding portion 28. The protruding portion 28 protrudes in a direction perpendicular to the first axis A1 direction from the portion of the third surface 24 that does not form the tearing blade 27 and the protruding portion 28.

Figure 4:
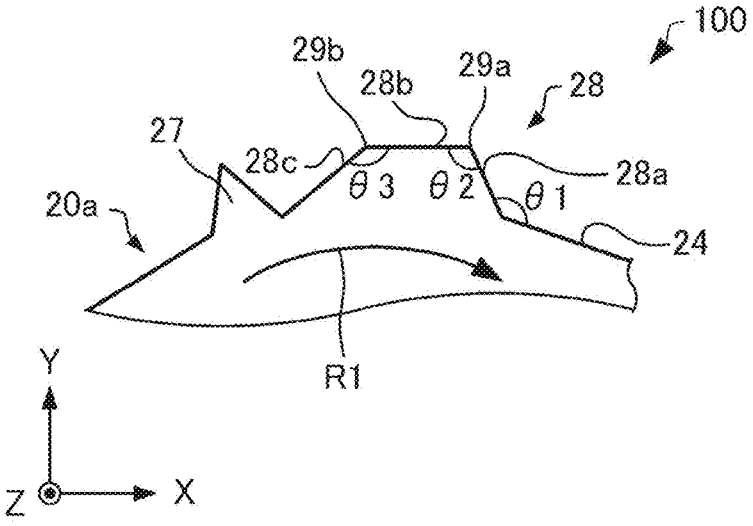
FIG. 4 is a plan view schematically illustrating the first rotary cutter of the crushing apparatus according to the first embodiment.

Here, FIG. 4 is a sectional view schematically illustrating the first rotary cutter 20*a*. As illustrated in FIG. 4, the third surface 24 of the protruding portion 28 has, for example, a front inclined surface 28*a*, a planar surface 28*b*, and a rear inclined surface 28*c*. The front inclined surface 28*a* of the first rotary cutter 20*a* is a surface that rises at an obtuse angle θ1 from the portion of the third surface 24 that does not form the protruding portion 28 and that is in front of the front inclined surface 28*a* in the rotation direction R1 of the first rotary cutter 20*a*. The front inclined surface 28*a* of the second rotary cutter 20*b* is a surface rising at an obtuse angle θ1 from a portion of the third surface 24 that does not form the protruding portion 28 and that is in front of the front inclined surface 28*a* in the rotation direction R2 of the second rotary cutter 20*b*. The planar surface 28*b* is a surface coupled to the front inclined surface 28*a* at an obtuse angle θ2 with the front inclined surface 28*a*. The rear inclined surface 28*c* is a surface coupled to the planar surface 28*b* at an obtuse angle θ2.

The protruding portion 28 has a corner portion 29*a* between the front inclined surface 28*a* and the planar surface 28*b*, and a corner portion 29*b* between the planar surface 28*b* and the rear inclined surface 28*c*. The corner portion 29*a* is a coupling portion between the front inclined surface 28*a* and the planar surface 28*b*, and is a corner portion formed of the front inclined surface 28*a* and the planar surface 28*b*. The corner portion 29*b* is a coupling portion between the planar surface 28*b* and the rear inclined surface 28*c*, and is a corner portion formed of the planar surface 28*b* and the rear inclined surface 28*c*. The corner portions 29*a* and 29*b* are obtuse corner portions. The corner portions 29*a* and 29*b* provided on the third surface 24 of the protruding portion 28 have an obtuse angle of 90° or more. The protruding portion 28 does not have any acute corner portions. The shape of the protruding portion 28 is, for example, substantially trapezoid when viewed from the Z-axis direction. The sheet S is bent by the protruding portion 28. No slits are formed in the sheet S by the protruding portion 28. Further, although not illustrated, the corner portions 29*a* and 29*b* may be chamfered.

The protruding portion 28 is, for example, provided in a plurality. The plurality of protruding portions 28 of the first rotary cutter 20*a* are provided at predetermined intervals along the rotation direction R1 of the first rotary cutter 20*a*. One tearing blade 27 is provided between adjacent ones of the protruding portions 28 in the rotation direction R1. The plurality of protruding portions 28 of the second rotary cutter 20*b* are provided at predetermined intervals along the rotation direction R2 of the second rotary cutter 20*b*. One tearing blade 27 is provided between adjacent ones of the protruding portions 28 in the rotation direction R2.

As illustrated in FIGS. 1 and 2, the first spacer 30*a* is provided on the first rotary shaft member 10*a*. The first spacer 30*a* is provided in a plurality. The first spacers 30*a* are configured so as to not rotate with the first rotary shaft member 10*a*. The first spacers 30*a* are each provided with a through hole 31*a* penetrating in the Z-axis direction, and the first rotary shaft member 10*a* passes through the through hole 31*a*. The first spacers 30*a* are fixed to the fixed frame 2 by rods 6.

The second spacer 30*b* is provided on the second rotary shaft member 10*b*. The second spacer 30*b* is provided in a plurality. The second spacers 30*b* are configured so as to not rotate with the second rotary shaft member 10*b*. The second spacers 30*b* are each provided with a through hole 31*b* penetrating in the Z-axis direction, and the second rotary shaft member 10*b* passes through the through hole 31*b*. The second spacer 30*b* are fixed to the fixed frame 2 by the rods 6. The material of the spacers 30*a* and 30*b* is, for example, a metal.

The first rotary cutters 20*a* and the first spacers 30*a* are alternately arranged in the first axis A1 direction. The second rotary cutters 20*b* and the second spacers 30*b* are alternately arranged in the first axis A1 direction. The first rotary cutters 20*a* and the second spacers 30*b* are disposed so as to face each other in the X-axis direction. In the illustrated example, the second spacer 30*b* is located away from the first rotary cutter 20*a* in the +X axis direction. The second rotary cutter 20*b* and the first spacer 30*a* are disposed facing each other in the X-axis direction. In the illustrated example, the first spacer 30*a* is located away from the second rotary cutter 20*b* in the −X-axis direction.

As viewed from the first axis A1 direction, a portion of the first rotary cutter 20*a* and a portion of the second rotary cutter overlap each other. In the direction of the first axis A1, a gap G is provided between the first rotary cutter 20*a* and the second rotary cutter 20*b*.

The first gap-forming member 40*a* is provided on the first rotary shaft member 10*a*. The first gap-forming member 40*a* is provided in a plurality. The first gap-forming member 40*a* is located between the first rotary cutter 20*a* and the first spacer 30*a*. The first gap-forming member 40*a* forms the gap G between the first rotary cutter 20*a* and the first spacer 30*a*.

The first gap-forming member 40*a* may rotate with the first rotary shaft member 10*a* or may not rotate with the first rotary shaft member 10*a*. The first gap-forming member 40*a* may be provided integrally with the first rotary cutter 20*a*, or may be provided integrally with the first spacer 30*a*.

The second gap-forming member 40*b* is provided on the second rotary shaft member 10*b*. The second gap-forming member 40*b* is provided in a plurality. The second gap-forming member 40*b* is located between the second rotary cutter 20*b* and the second spacer 30*b*. The second gap-forming member 40*b* forms the gap G between the second rotary cutter 20*b* and the second spacer 30*b*.

The second gap-forming member 40*b* may rotate with the second rotary shaft member 10*b* or may not rotate with the second rotary shaft member 10*b*. The second gap-forming member 40*b* may be provided integrally with the second rotary cutter 20*b*, or may be provided integrally with the second spacer 30*b*. The material of the gap-forming members 40*a* and 40*b* is, for example, a metal.

1.1.2. Action

As illustrated in FIG. 2, when the sheet S is loaded in the −Y axis direction, the sheet S is placed between the first rotary cutter 20*a* and the second spacer 30*b* and enters a gap between the second rotary cutter 20*b* and the first spacer 30*a*.

The sheet S is slit by the tearing blade 27 of the first rotary cutter 20*a* while being guided by the front inclined surface 28*a* of the protruding portion 28 of the second rotary cutter 20*b*. Specifically, as illustrated in FIG. 1, the tearing blade 27 of a first rotary cutter 20*a*1 enters a gap between the front inclined surfaces 28*a* of the protruding portions 28 of second rotary cutters 20*b*1 and 20*b*2 adjacent thereto in the Z axis direction, and a slit is formed in the sheet S in the Z axis direction. Because a slit is formed by the tearing blade 27 while the sheet S is pressed by the protruding portions 28 of the second rotary cutters 20*b*1 and 20*b*2 that are adjacent thereto, the cut surface formed by the tearing blade 27 is rough. Furthermore, the sheet S is pushed by the protruding portions 28 and ends up having a bent shape.

Similarly, the sheet S is guided by the front inclined surface 28*a* of the protruding portion 28 of the first rotary cutter 20*a*, and a slit is formed by the tearing blade 27 of the second rotary cutter 20*b*.

Next, with the rotation of the rotary cutters 20*a* and 20*b*, the sheet S is cut in a direction parallel to the XY plane. Specifically, the sheet S is cut by the corner portions 25 and 26 of the rotary cutters 20*a* and 20*b* to form a plurality of small pieces. Here, because a gap G is provided between the first rotary cutter 20*a* and the second rotary cutter 20*b* in the Z-axis direction, the cut surface formed by the corner portions 25 and 26 is rough.

As described above, the sheet S is roughly crushed by the crushing apparatus 100 into a plurality of small pieces. The small pieces have a strip shape. The cut surface of the small piece in the transverse direction is formed by the tearing blade 27, and the cut surface of the small piece in the longitudinal direction is formed by the corner portions 25 and 26.

1.1.3. Features

The crushing apparatus 100 has, for example, the following features.

In the crushing apparatus 100, a gap G is provided between the first rotary cutter 20*a* and the second rotary cutter 20*b* in the first axis A1 direction. Therefore, in the crushing apparatus 100, compared with the case where a first rotary cutter and a second rotary cutter come into contact, the sharpness of the rotary cutters 20*a* and 20*b* is poor, and small pieces containing long fibers can be formed. Therefore, when the small pieces formed by the crushing apparatus 100 are used in the paper recycling apparatus, the paper recycling apparatus can produce recycled paper with high paper strength. In addition, for example, in order to increase paper strength, because the amount of binder that binds the fibers to each other can be reduced, the cost can be reduced and the environmental load can be reduced. For example, in the crushing apparatus 100, the longitudinal-direction cut surface of the small piece formed by the rotary cutters 20*a* and 20*b* can be roughened and a small piece having a large surface area can be formed.

In the crushing apparatus 100, the third surface 24 forms the protruding portion 28 which protrudes in a direction perpendicular to the first axis A1 direction, and the protruding portion 28 does not have any sharp corner portions. Therefore, in the crushing apparatus 100, a bent piece can be formed by pressing the sheet S with the protruding portion 28.

The first gap-forming member 40*a* that is provided on the first rotary shaft member 10*a* and that forms the gap G, and the second gap-forming member 40*b* that is provided on the second rotary shaft member 10*b* and that forms the gap G are included in the crushing apparatus 100. Therefore, in the crushing apparatus 100, the size of the gap G can be easily adjusted by the gap-forming members 40*a* and 40*b*.

The size of the gap G is preferably 1 mm or more and 5 mm or less. When the size of the gap G is smaller than 1 mm, the sharpness by the first rotary cutter 20*a* and the second rotary cutter 20*b* is good, and the roughening of small pieces may be reduced. When the size of the gap G is larger than 5 mm, for example, the pressing force applied to the sheet S by the protruding portion 28 of the second rotary cutter 20*b* that is adjacent thereto is weakened, and the roughening of the small pieces may be reduced.

1.2. Manufacturing Method for Crushing Apparatus

Figure 5:
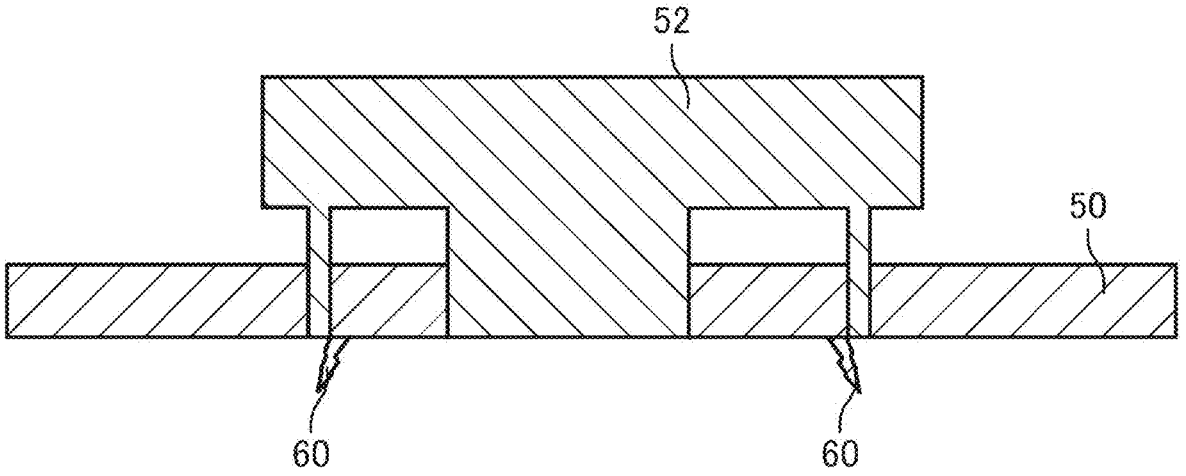
FIG. 5 is a sectional view schematically illustrating a manufacturing process for the crushing apparatus according to the first embodiment.
Figure 6:
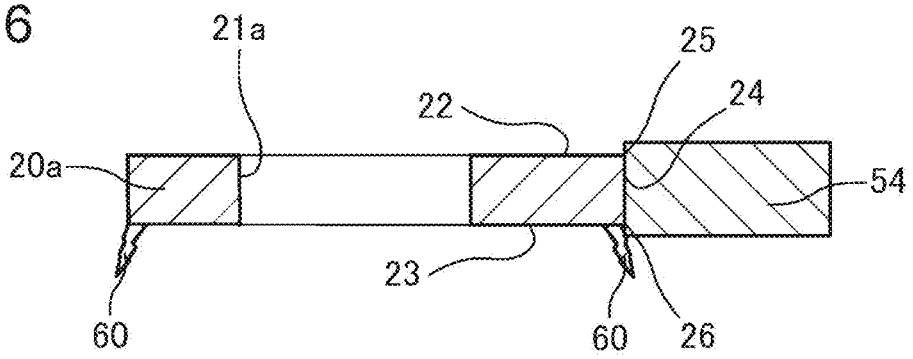
FIG. 6 is a sectional view schematically illustrating the manufacturing process for the crushing apparatus according to the first embodiment.
Figure 7:
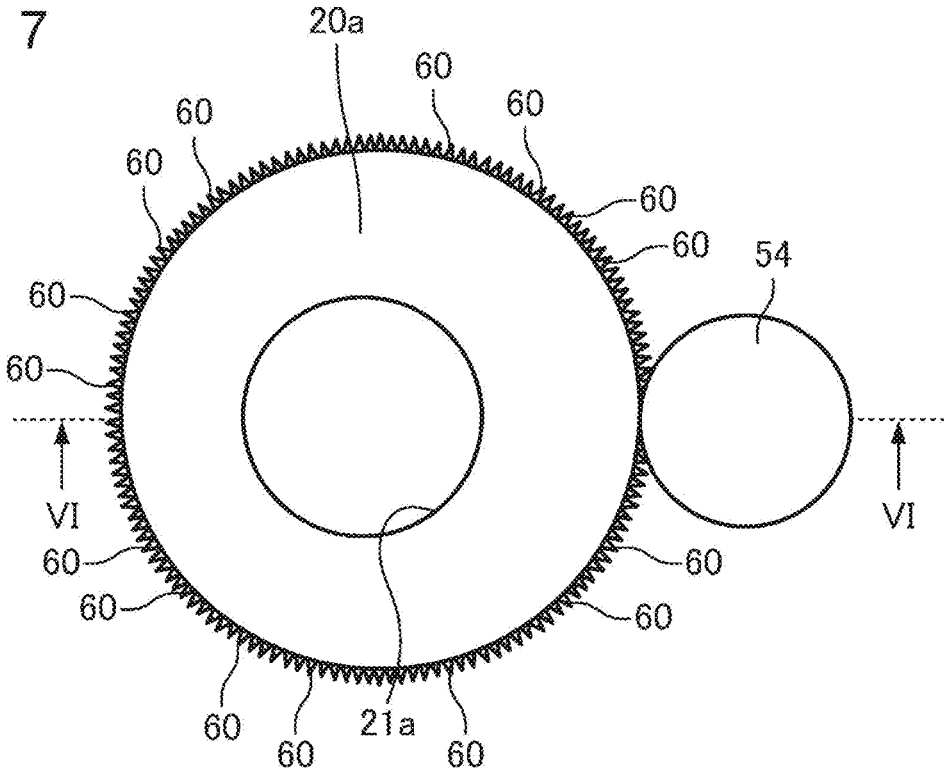
FIG. 7 is a plan view schematically illustrating the manufacturing process for the crushing apparatus according to the first embodiment.

Next, the manufacturing method for the crushing apparatus 100 according to the first embodiment will be described with reference to the drawings. FIGS. 5 and 6 are sectional views schematically illustrating the manufacturing process for the crushing apparatus 100 according to the first embodiment. FIG. 7 is a plan view schematically illustrating the manufacturing process for the crushing apparatus 100 according to the first embodiment. Further, FIG. 6 is a sectional view taken along line VI-VI illustrated in FIG. 7.

As illustrated in FIG. 5, for example, a plate-like member 50 is prepared. Next, the plate-like member 50 is punched into a predetermined shape by a press machine 52. Consequently, the rotary cutters 20*a* and 20*b* can be formed.

As illustrated in FIG. 6, burrs 60 are generated in the rotary cutters 20*a* and 20*b* processed by the press machine 52. The burrs 60 are generated at the corner portion 26 between the second surface 23 opposite to the first surface 22 pressed by the press machine 52 and the third surface 24. Then, as illustrated in FIGS. 6 and 7, the third surface 24 is polished by a polishing member 54 to remove the burrs 60.

Further, although the burrs may occur also in the corner portion of the inner surface of the through hole 21*a* and the second surface 23, these burrs are omitted in the example illustrated. In addition, for convenience, FIG. 7 illustrates the first rotary cutter 20*a* in a simplified manner.

Next, similarly to the rotary cutters 20*a* and 20*b*, the spacers 30*a* and 30*b*, and the gap-forming members 40*a* and 40*b* are formed using a press machine.

Next, as illustrated in FIG. 1, the first rotary cutter 20*a*, the first spacer 30*a*, and the first gap-forming member 40*a* are inserted into the first rotary shaft member 10*a*, and the second rotary cutter 20*b*, the second spacer 30*b*, and the second gap-forming member 40*b* are inserted into the second rotary shaft member 10*b*.

The crushing apparatus 100 can be manufactured by the above process.

Figure 8:
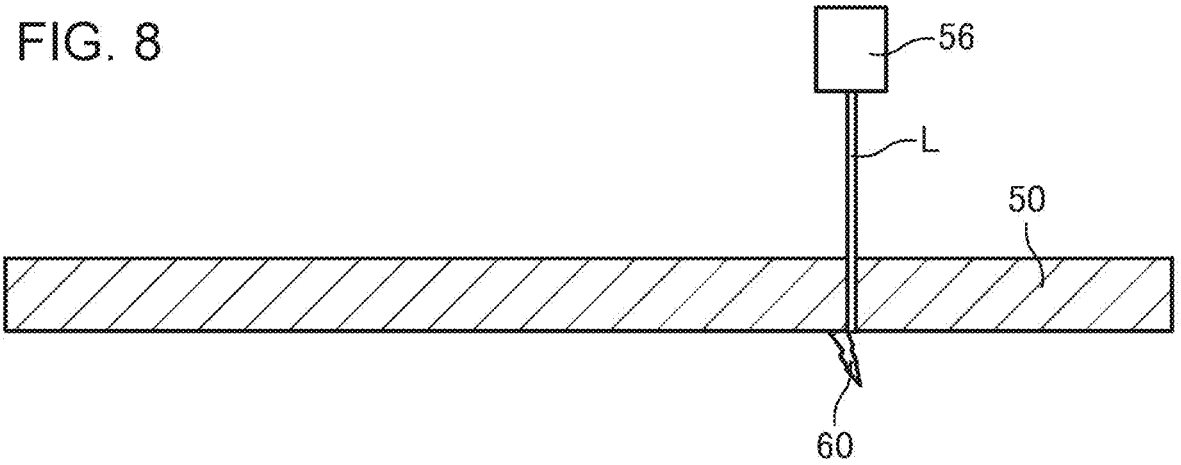
FIG. 8 is a sectional view schematically illustrating the manufacturing process for the crushing apparatus according to the first embodiment.

Further, the rotary cutters 20*a* and 20*b* may be processed by a laser element 56 that emits laser light L, as illustrated in FIG. 8, rather than the press machine 52. Even in this case, because the burrs 60 are generated in the rotary cutters 20*a* and 20*b*, the burrs 60 are removed by the polishing member 54. The same applies to the spacers 30*a* and 30*b*, and the gap-forming members 40*a* and 40*b*.

2. Second Embodiment

2.1. Crushing Apparatus

Figure 9:
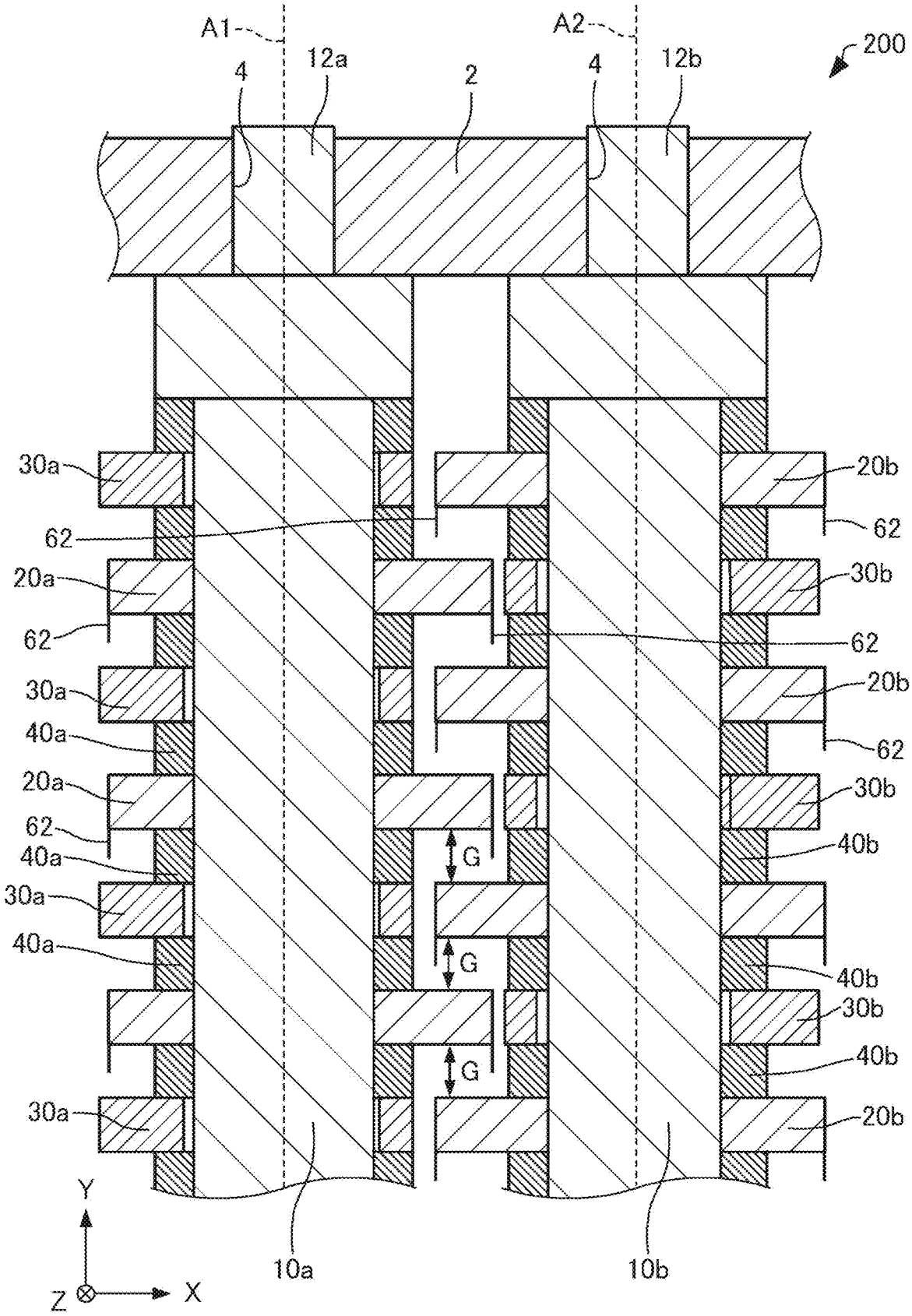
FIG. 9 is a sectional view schematically illustrating a crushing apparatus according to a second embodiment.
Figure 10:
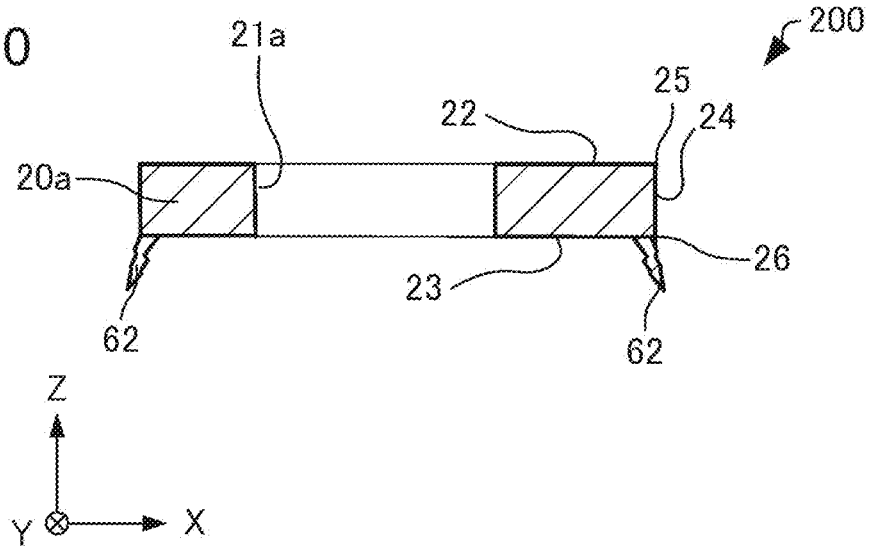
FIG. 10 is a sectional view schematically illustrating a first rotary cutter of the crushing apparatus according to a second embodiment.

Next, a crushing apparatus according to a second embodiment will be described with reference to the drawings. FIG. 9 is a sectional view schematically illustrating a crushing apparatus 200 according to the second embodiment. FIG. 10 is a sectional view schematically illustrating the first rotary cutter 20*a* of the crushing apparatus 200 according to the second embodiment. Hereinafter, in the crushing apparatus 200 according to the second embodiment, differences from the example of the crushing apparatus 100 according to the first embodiment mentioned above are described, and description of similar points is omitted.

As illustrated in FIGS. 9 and 10, the crushing apparatus 200 is different from the crushing apparatus 100 described above in that the rotary cutters 20*a* and 20*b* have a ripping blade 62. Further, for convenience, FIG. 9 illustrates the ripping blade 62 in a simplified manner.

The ripping blade 62 protrudes from the corner portion 26 in a direction intersecting the second surface 23. The ripping blade 62 protrudes from the corner portion 26 in a direction intersecting the Y-axis direction. In the example illustrated in FIG. 10, the ripping blade 62 protrudes in a direction inclined with respect to the Z-axis direction. The ripping blade 62 may protrude in the Z-axis direction. The ripping blade 62 is not provided at the corner portion 25. The rotary cutters 20*a* and 20*b* have the ripping blade 62 between the second surface 23 and the third surface 24.

The ripping blade 62 is, for example, a burr generated when the rotary cutters 20*a* and 20*b* are formed. The ripping blade 62 is, for example, provided in a plurality along the entire circumference of the corner portion 26. The size of the gap G is larger than the size of the ripping blades 62 in the first axis A1 direction. Thereby, it is possible to prevent the ripping blades 62 and the spacers 30*a* and 30*b* from coming into contact with each other.

In the crushing apparatus 200, since the rotary cutters 20*a* and 20*b* have the ripping blades 62 protruding from the corner portion 26 in a direction intersecting the second surface 23, the sharpness is dulled due to the shearing force of the rotary cutters 20*a* and 20*b*, and the sheet S can be cut so as to be ripped with the ripping blades 62. Therefore, the cut surface of the small pieces can be roughened more.

2.2. Manufacturing Method for Crushing Apparatus

Next, a manufacturing method for the crushing apparatus 200 according to the second embodiment will be described. Hereinafter, in the manufacturing method of the crushing apparatus 200 according to the second embodiment, differences from the example of the manufacturing method of the crushing apparatus 100 according to the first embodiment described above will be described, and description of similar points will be omitted.

In the manufacturing method for the crushing apparatus 100 described above, as illustrated in FIGS. 6 and 7, there is a step of removing the burrs 60 generated in the rotary cutters 20*a* and 20*b*.

On the other hand, the manufacturing method of the crushing apparatus 200 does not have the process of removing the burrs that are generated in the rotary cutters 20*a* and 20*b*. In the crushing apparatus 200, burrs generated in the rotary cutters 20*a* and 20*b* are used as the ripping blades 62. Therefore, in the method of manufacturing the crushing apparatus 200, it is not necessary to have a separate process for forming the ripping blades 62, and the process can be shortened.

2. 3. Modification of Crushing Apparatus

Figure 11:
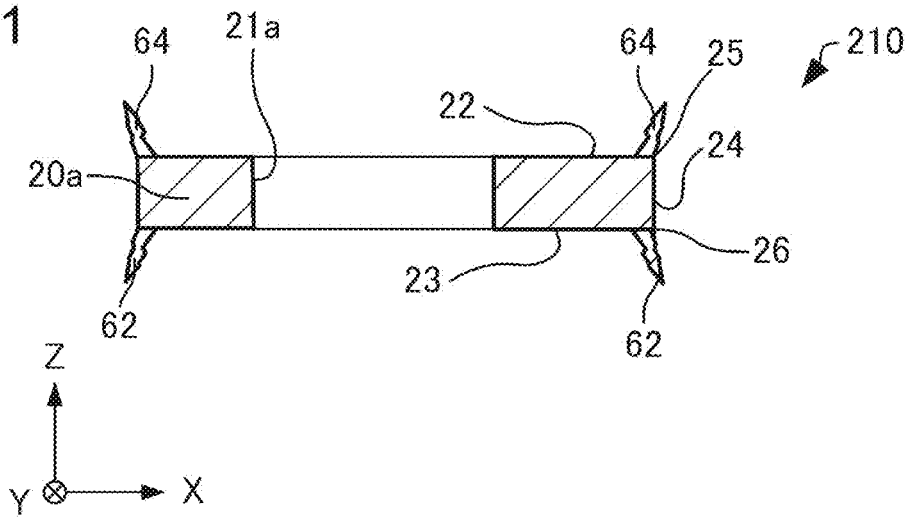
FIG. 11 is a sectional view schematically illustrating a first rotary cutter of a crushing apparatus according to a modification of the second embodiment.

Next, a crushing apparatus according to a modification of the second embodiment will be described with reference to the drawings. FIG. 11 is a sectional view schematically illustrating a crushing apparatus 210 according to a modification of the second embodiment. Hereinafter, in the crushing apparatus 210 according to the modification of the second embodiment, differences from the example of the crushing apparatus 200 according to the second embodiment described above will be described, and description of similar points will be omitted.

As illustrated in FIG. 11, the crushing apparatus 210 is different from the crushing apparatus 200 described above in that a ripping blade 64 is provided at the corner portion 25.

The ripping blade 64 protrudes from the corner portion 25 in a direction intersecting the first surface 22. The ripping blade 64 protrudes from the corner portion 25 in a direction intersecting with the Y-axis direction. In the example illustrated in FIG. 11, the ripping blade 64 protrudes in a direction inclined with respect to the Z-axis direction. The ripping blade 64 may protrude in the Z-axis direction.

The ripping blade 64 is, for example, a burr generated when the rotary cutters 20*a* and 20*b* are formed. The ripping blade 64 is, for example provided in a plurality along the entire circumference of the corner portion 25. The size of the gap G is larger than the size of the ripping blades 64 in the first axis A1 direction. Thereby, it is possible to prevent the ripping blades 64 and the spacers 30*a* and 30*b* from coming into contact with each other.

In the crushing apparatus 200, because the rotary cutters 20*a* and 20*b* have the ripping blades 62 and 64, the sharpness of the rotary cutters 20*a* and 20*b* is poor, and the sheet S can be cut so as to be ripped by the ripping blades 62 and 64. Therefore, the cut surface of the small pieces can be roughened more.

Figure 12:
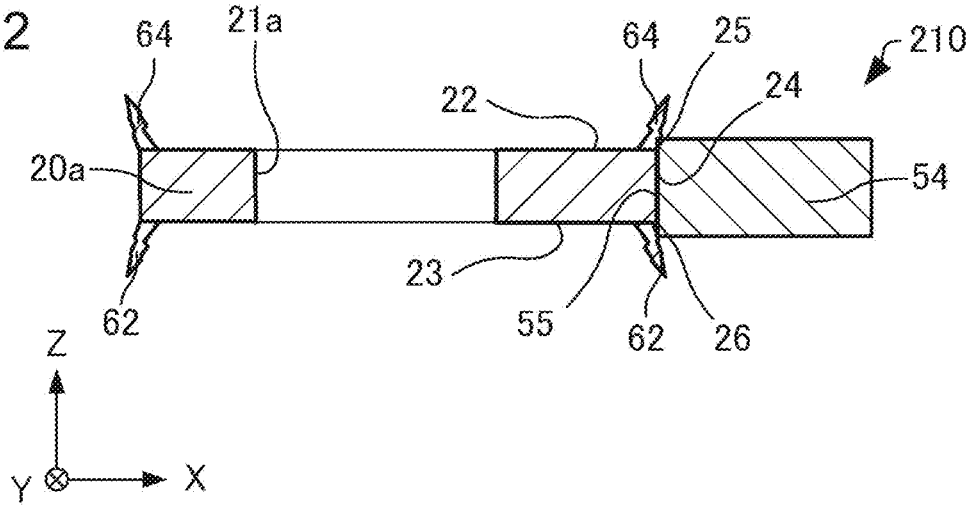
FIG. 12 is a sectional view schematically illustrating a manufacturing process for the crushing apparatus according to the modification of the second embodiment.

The ripping blades 64 are formed by, for example, forming the rotary cutters 20*a* and 20*b* with a press machine and then polishing the third surface 24 with the polishing member 54 having a rough polishing surface 55 as illustrated in FIG. 12. Further, FIG. 12 is a sectional view schematically illustrating a manufacturing process for the crushing apparatus 210 according to the modification of the second embodiment.

3. Examples and Comparative Examples

Hereinafter, the present disclosure will be described more specifically with reference to examples and comparative examples. Further, the present disclosure is not limited to the following examples and comparative examples.

3.1. Example 1 and Comparative Example 1

As Example 1, small pieces were formed using a crushing apparatus corresponding to the crushing apparatus 100 illustrated in FIGS. 1 and 2. In the crushing apparatus of Example 1, a gap is provided between the first rotary cutter and the second rotary cutter. In addition, the first rotary cutter and the second rotary cutter have protruding portions.

As Comparative Example 1, small pieces were formed using "specifications: small piece size of 2 mm×23 mm" of a shredder "SECRET P143S" manufactured by Ishizawa Seisakusho Co., Ltd. In the crushing apparatus of Comparative Example 1, the first rotary cutter and the second rotary cutter are in contact with each other. In addition, the first rotary cutter and the second rotary cutter do not have protruding portions.

Figure 13:
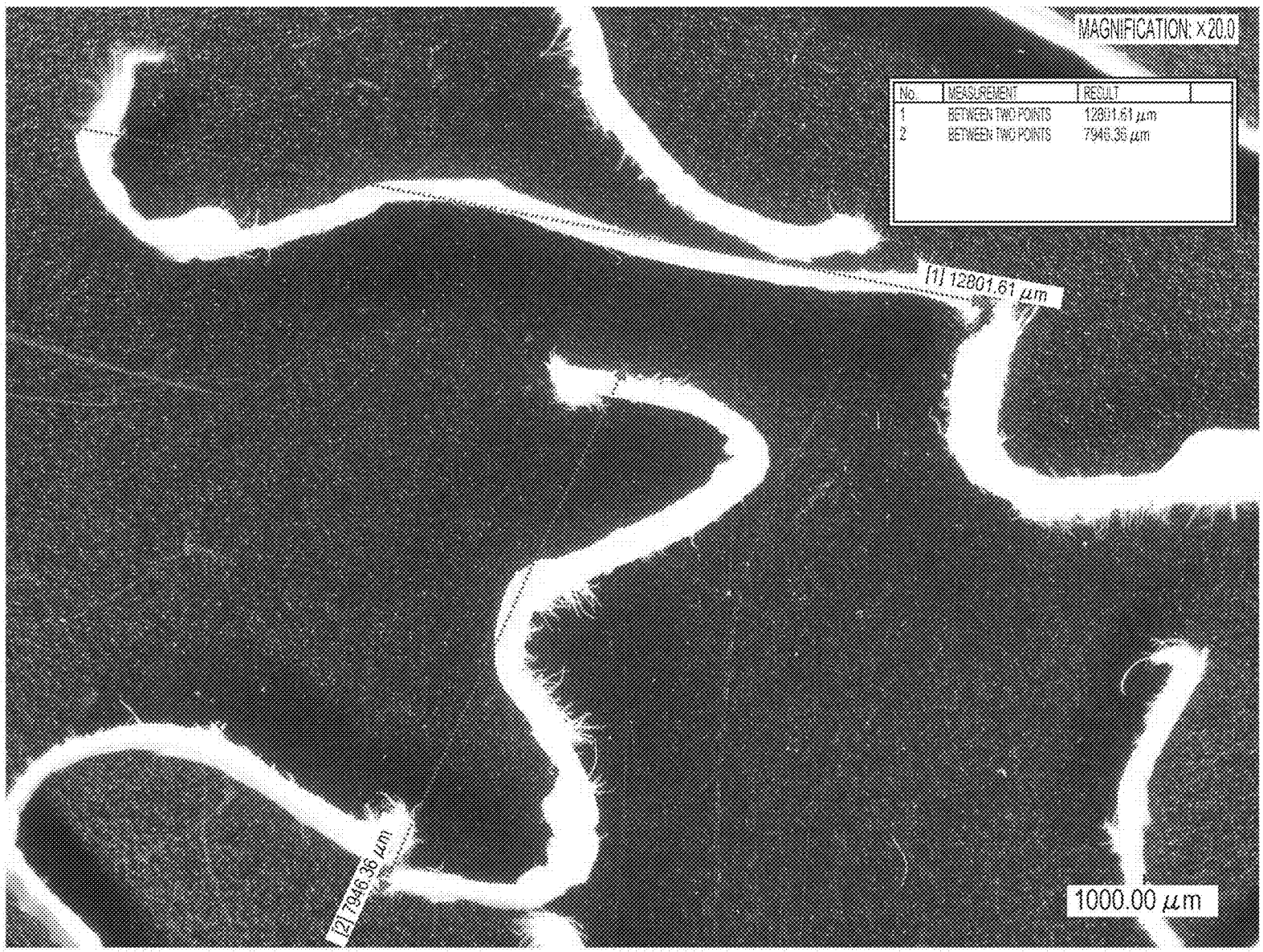
FIG. 13 is a photograph illustrating small pieces of Example 1.
Figure 14:
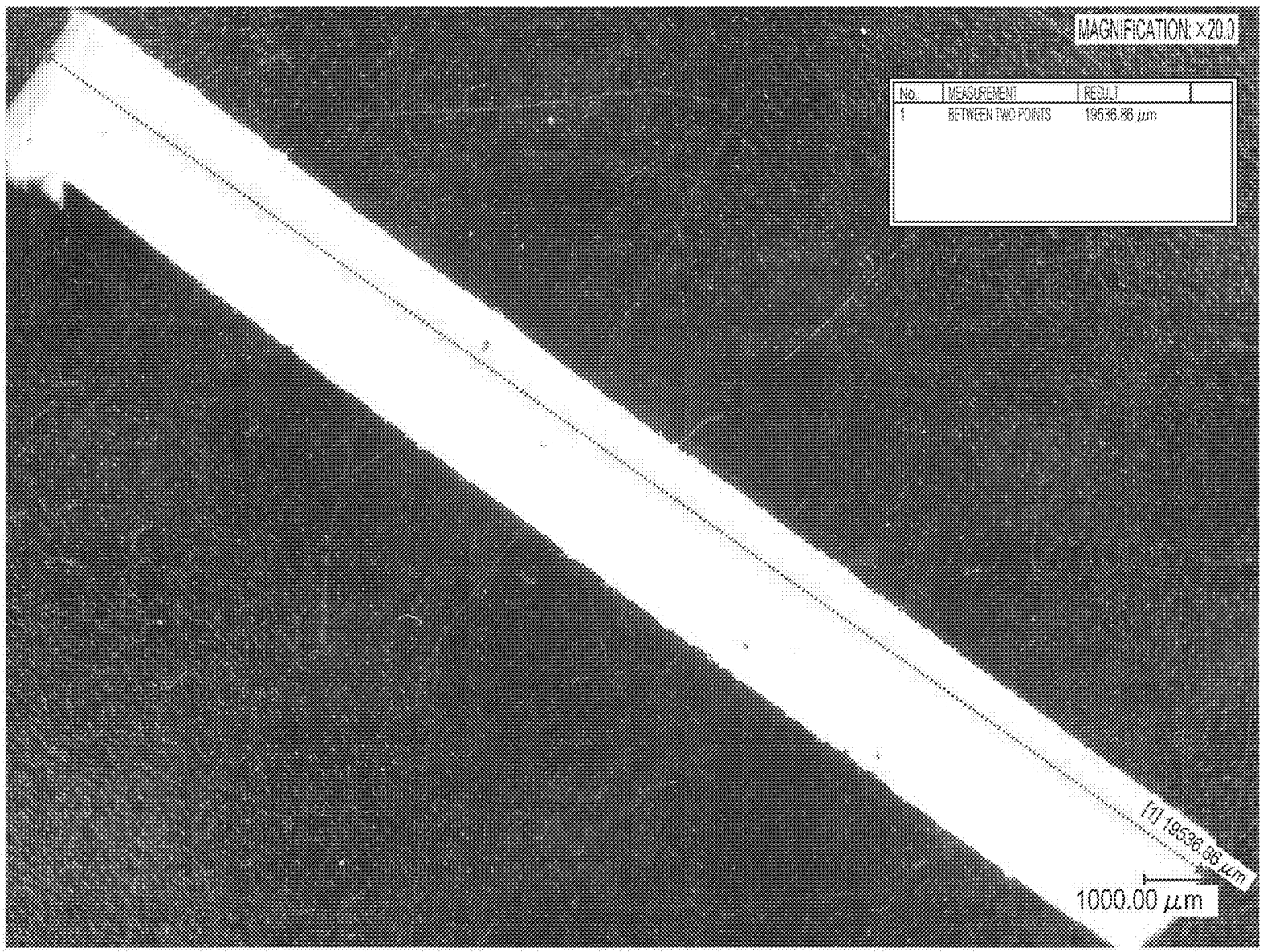
FIG. 14 is a photograph illustrating a small piece of Comparative Example 1.

FIG. 13 is a photograph illustrating small pieces of Example 1. FIG. 14 is a photograph illustrating a small piece of Comparative Example 1.

By comparing FIG. 13 with FIG. 14, it was found that with respect to the small pieces of Example 1, both the cut surfaces in the long side direction and the cut surfaces in the short side direction were roughened as compared with Comparative Example 1. This is because in the crushing apparatus of Example 1, a gap is provided between the first rotary cutter and the second rotary cutter. In addition, another reason is that slits were formed in the sheet while being pressed by protruding portions.

3.2. Example 2 and Comparative Example 2

As Example 2, small pieces were formed using a crushing apparatus corresponding to the crushing apparatus 100 illustrated in FIGS. 1 and 2. In the crushing apparatus of Example 2, a gap is provided between the first rotary cutter and the second rotary cutter. However, the first rotary cutter and the second rotary cutter do not have protruding portions.

As Comparative Example 2, small pieces were formed using a crushing apparatus similar to the crushing apparatus of Example 2 except that the first rotary cutter and the second rotary cutter were in contact with each other.

Figure 15:
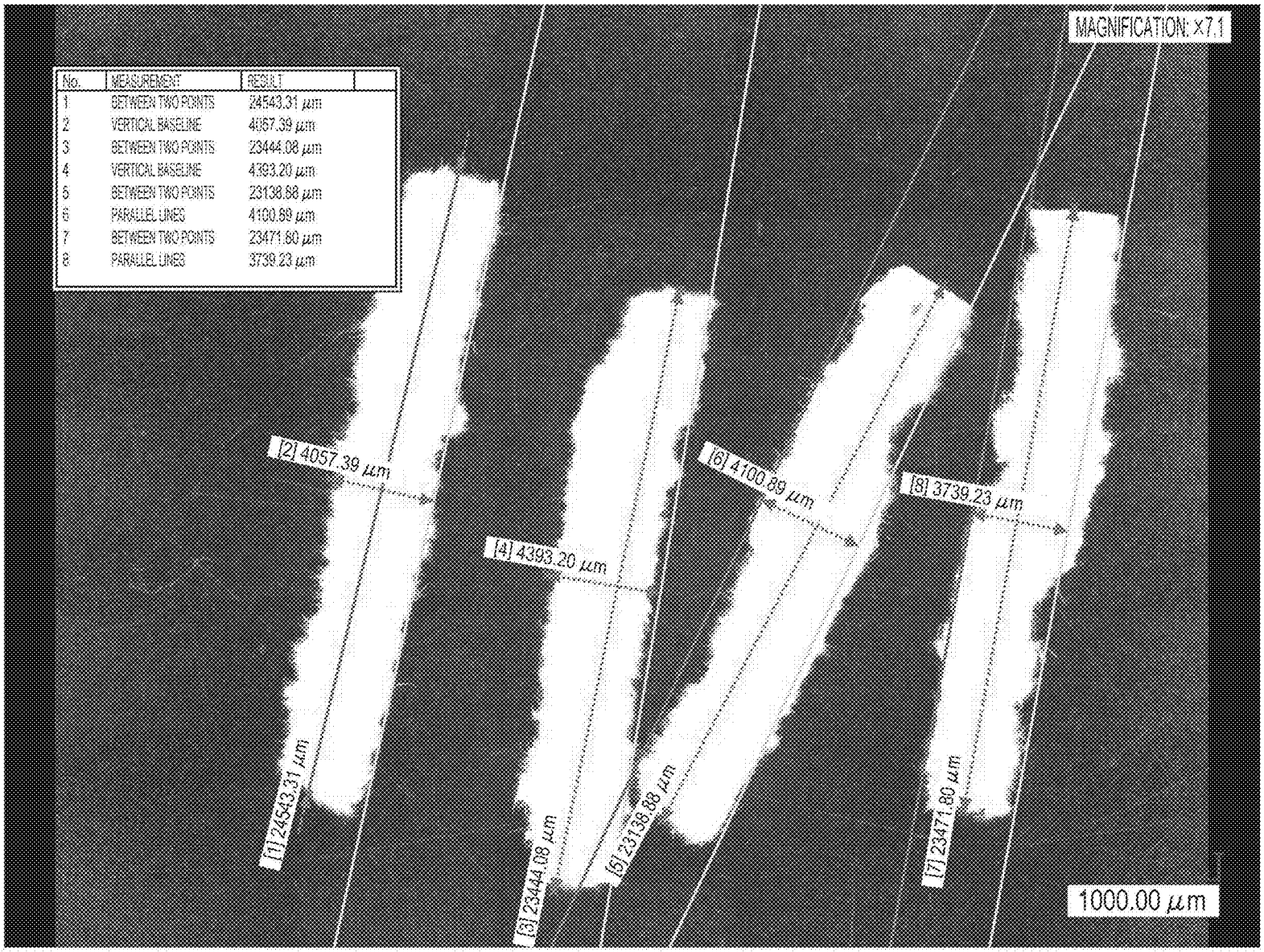
FIG. 15 is a photograph illustrating small pieces of Example 2.
Figure 16:
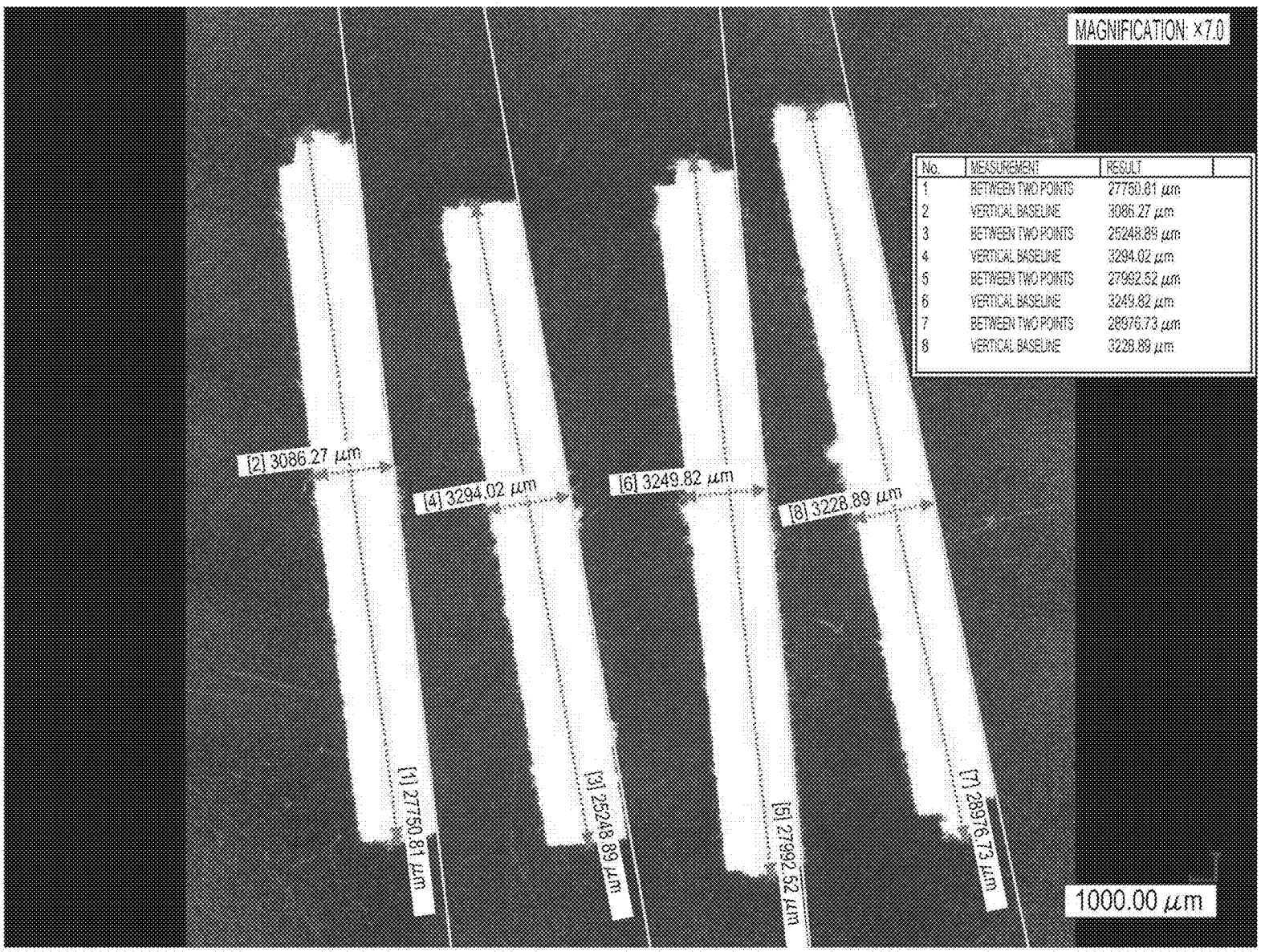
FIG. 16 is a photograph illustrating small pieces of Comparative Example 2.

FIG. 15 is a photograph illustrating small pieces of Example 2. FIG. 16 is a photograph illustrating small pieces of Comparative Example 2.

As illustrated in FIG. 15 and FIG. 16, with respect to the small pieces of Example 2, cut surfaces in the long side direction and in the short side direction were found to be rough and uneven as compared with Comparative Example 2.

Next, the fiber lengths of the small pieces of Example 2 and the small pieces of Comparative Example 2 were measured. Small pieces of Example 2 and Comparative Example 2 having a longitudinal-direction size of 25 mm and a transverse-direction size of 3.5 mm were prepared. As the fiber length measuring machine, a fiber tester "CODE912" manufactured by Lorentzen & Wettre Ltd. was used. For the small pieces of Example 2 and Comparative Example 2, 100 ml suspensions each containing 0.1 g of fiber were prepared, and the average fiber length was measured.

The average fiber length of the small pieces of Comparative Example 2 was 0.770 mm, whereas the average fiber length of the small pieces of Example 2 was as long as 0.785 mm. This is because in the crushing apparatus of Example 2, a gap is provided between the first rotary cutter and the second rotary cutter. Further, the fiber length was 0.803 mm when separated into water without making small pieces.

The present disclosure is not limited to the above-described embodiments, and various modifications can be made. For example, the present disclosure includes substantially the same configuration as that described in the embodiments. The substantially same configuration is, for example, a configuration having the same function, method, and result, or a configuration having the same purpose and effect. In addition, the present disclosure includes a configuration in which a non-essential part of the configuration described in the embodiment is replaced. In addition, the present disclosure includes a configuration that achieves the same effect as the configuration described in the embodiment or a configuration that can achieve the same object. In addition, the present disclosure includes a configuration in which known art has been added to the configuration described in the embodiment.

What is claimed is:

1. A crushing apparatus comprising:

a first rotary shaft member that rotates about a first axis;

a second rotary shaft member that rotates about a second axis parallel to the first axis in an opposite direction to a direction in which the first rotary shaft member rotates;

a plurality of first rotary cutters provided on the first rotary shaft member and rotating together with the first rotary shaft member;

a plurality of second rotary cutters provided on the second rotary shaft member and rotating together with the second rotary shaft member;

a plurality of first spacers provided on the first rotary shaft member; and a plurality of second spacers provided on the second rotary shaft member, wherein the first rotary cutters and the first spacers are alternately disposed in a first axis direction, the second rotary cutters and the second spacers are alternately disposed in the first axis direction, the first rotary cutters and the second rotary cutters each form a tearing blade that protrudes in a direction perpendicular to the first axis direction, a portion of each of the first rotary cutters and a portion of each of the second rotary cutters overlap when viewed from the first axis direction, and a gap is provided between the first rotary cutter and the second rotary cutter in the first axis direction; and wherein the first rotary cutter and the second rotary cutter each include:

a first surface and a second surface that are perpendicular to the first axis direction, a third surface formed in a thickness direction of the first rotary cutter and the second rotary cutter, the tearing blade being provided on the third surface, and a ripping blade protruding in a direction intersecting the second surface between the second surface and the third surface, and a size of the gap is larger than a size of the ripping blade in the first axis direction.

2. The crushing apparatus according to claim 1, wherein the third surface includes a protruding portion protruding in the direction perpendicular to the first axis direction, and a corner portion of the protruding portion provided on the third surface has an obtuse angle of 90° or more, or the corner portion is chamfered.

3. The crushing apparatus according to claim 1, further comprising:

a first gap-forming member provided on the first rotary shaft member and forming the gap; and a second gap-forming member provided on the second rotary shaft member and forming the gap.

* * * * *